US007192313B2

(12) United States Patent
Sai

(10) Patent No.: US 7,192,313 B2
(45) Date of Patent: Mar. 20, 2007

(54) AUTOMOBILE CONNECTOR ASSEMBLY WITH SHORT CIRCUIT PREVENTION FEATURE

(75) Inventor: Noriaki Sai, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 11/376,000

(22) Filed: Mar. 15, 2006

(65) Prior Publication Data

US 2006/0211274 A1 Sep. 21, 2006

(30) Foreign Application Priority Data

Mar. 16, 2005 (JP) ..... 2005-075483

(51) Int. Cl.
*H01R 33/00* (2006.01)

(52) U.S. Cl. ..... 439/660; 439/693

(58) Field of Classification Search ..... 439/34, 439/181, 660, 886, 912, 856–857, 693
See application file for complete search history.

(56) References Cited

U.S. PATENT DOCUMENTS

| | | | | |
|---|---|---|---|---|
| 3,869,191 | A * | 3/1975 | Tolnar et al. | 439/186 |
| 4,995,829 | A * | 2/1991 | Geib et al. | 439/409 |
| 5,108,311 | A * | 4/1992 | Nakazawa | 439/607 |
| 5,518,421 | A * | 5/1996 | Davis | 439/607 |
| 5,584,709 | A * | 12/1996 | Kiat | 439/79 |
| 5,797,770 | A | 8/1998 | Davis et al. | |
| 5,823,799 | A * | 10/1998 | Tor et al. | 439/79 |
| 5,885,107 | A * | 3/1999 | Sluss et al. | 439/595 |
| 6,443,773 | B1 * | 9/2002 | Korsunsky et al. | 439/660 |
| 6,478,586 | B1 * | 11/2002 | Ma | 439/79 |
| 6,527,592 | B2 * | 3/2003 | Mochizuki et al. | 439/660 |
| 6,860,746 | B2 * | 3/2005 | Ota et al. | 439/181 |
| 6,948,984 | B2 * | 9/2005 | Chen et al. | 439/660 |
| 2002/0168896 | A1 | 11/2002 | Suzuki | |

FOREIGN PATENT DOCUMENTS

| | | | |
|---|---|---|---|
| CA | 643242 | * | 6/1962 |
| JP | 2003-095037 | | 4/2003 |

* cited by examiner

*Primary Examiner*—Neil Abrams
(74) *Attorney, Agent, or Firm*—Barley Snyder LLC

(57) ABSTRACT

An automobile connector assembly connects a power supply side and an electrical load side of an electrical circuit in an automobile. The assembly comprises a female terminal connector disposed on the electrical load side of the electric circuit. The female terminal connector has a female housing provided with female terminals positioned within female terminal accommodating openings. A male terminal connector mates with the female terminal connector. The male terminal connector is disposed on the power supply side of the electric circuit and has an insulating male housing provided with male terminals. Insulating resin members cover tip ends and both side surfaces of each of the male terminals to prevent short-circuiting and are discharge between adjacent terminals. The female and male terminals may include power supply and signal terminals, and the female terminals may include exposed portions for test probe use.

20 Claims, 11 Drawing Sheets

AUTOMOBILE CONNECTOR ASSEMBLY WITH SHORT CIRCUIT PREVENTION FEATURE

FIELD OF THE INVENTION

The invention relates to an automobile connector assembly used to connect electrical circuits in automobiles.

BACKGROUND OF THE INVENTION

Generally, in electrical circuits used in automobiles, a power supply side and an electrical load side are connected via an automobile connector assembly consisting of male terminal connectors and female terminal connectors that mate with each other. In recent years, 42 V high-voltage automobiles have been developed, which mount a motor-generator that is advantageous for fuel economy. In these high-voltage automobiles, the voltage is three times that used in current vehicle power supplies (14 V). As a result, there is a high probability of short-circuiting and arc discharge during line assembly and servicing. Accordingly, countermeasures against such problems are indispensable from the standpoint of safety and fire prevention.

One example of an automobile connector assembly that prevents short-circuiting and are discharge during line assembly and servicing is shown in FIGS. 16A–16C (see JP 2003-95037A). FIG. 16A shows an automobile electrical circuit 101 comprising a power supply 102 that supplies a specified power supply voltage (42 V), an electrical load 108 that is operated by the power supply 102, and an automobile connector assembly 104 that connects the power supply 102 and the electrical load 108. A fuse 103 that prevents the flow of an overcurrent is connected between the power supply 102 and the automobile connector assembly 104. A switch 107 that drives the electrical load 108 is connected between the automobile connector assembly 104 and the electrical load 108.

FIG. 1 shows an electrical circuit 1 for an automobile comprising a power supply 2 that supplies a specified power supply voltage (42 V), an electrical load 8 that is operated by the power supply 2, and an automobile connector assembly 4 that connects the power supply 2 and the electrical load 8. The automobile connector assembly 4 is constructed from a male terminal connector 5 that is disposed on a side of the power supply 2 and a female terminal connector 6 that is disposed on a side of the electrical load 8. The male terminal connector 5 and the female terminal connector 6 are formed to mate with each other. A fuse 3, which prevents the flow of an overcurrent, is connected between the power supply 2 and the automobile connector assembly 4. A switch 7, which drives the electrical load 8, is connected between the automobile connector assembly 4 and the electrical load 8.

The automobile connector assembly 104 is constructed from a female terminal connector 105 disposed on a side of the power supply 102, and a male terminal connector 106 disposed on a side of the electrical load 108. As shown in FIG. 16B, the female terminal connector 105 is constructed from an insulating housing 105*a* that has a plurality of terminal accommodating openings 105*b* and a plurality of female terminals (not shown) that are accommodated inside the respective terminal accommodating openings 105*b*. The respective female terminals (not shown) are connected to respective lines on the side of the power supply 102.

A shown in FIG. 16C, the male terminal connector 106 is constructed from an insulating housing 106*a* that has a mating recessed member 106*b* with which the female terminal connector 105 mates and a plurality of male terminals 106*c* that are press-fitted to the housing 106*a*. The respective male terminals 106*c* are connected to respective lines on the side of the electrical load 108 and are arranged so that the male terminals 106*c* are received in and make contact with the female terminals (not shown) when the female terminal connector 105 is caused to mate with the male terminal connector 106.

In the automobile connector assembly 104 shown in FIGS. 16A–16C, because the female terminal connector 105 is disposed on the side of the power supply 102, the male terminal connector 106 is disposed on the side of the electrical load 108, the female terminal connector 105 is connected to the side to which the power supply voltage is applied, and the female terminals (not shown) are accommodated inside the relatively small terminal accommodating openings 105*b* in the female terminal connector 105, short-circuiting and arc discharge can be prevented during line assembly and servicing. As a result, safety and fire prevention can be improved.

Several problems have been encountered, however, in the automobile connector assembly 104 shown in FIGS. 16A–16C. Specifically, in the female terminal connector 105, it is necessary to form walls between the mutually adjacent terminal accommodating openings 105*b* to prevent short-circuiting and arc discharge between the adjacent female terminals (not shown). The walls must have a thickness capable of preventing short-circuiting and arc discharge between the adjacent female terminals (not shown). This is particularly important where a power supply voltage of 42 V is used in a high-voltage automobile, in order to prevent short-circuiting and arc discharge between the adjacent female terminals of the female terminal connector 105 disposed on the side of the power supply 102. The size of the female terminal connector 105 therefore must be increased to accommodate the walls.

BRIEF SUMMARY OF THE INVENTION

The present invention was devised in light of the problems described above and provides an automobile connector assembly that has a reduced size and prevents short-circuiting and arc discharge between adjacent terminals.

The present invention provides an automobile connector assembly that connects a power supply side and an electrical load side of an electrical circuit in an automobile. The assembly comprises a female terminal connector disposed on the electrical load side of the electric circuit. The female terminal connector has a female housing provided with female terminals positioned within female terminal accommodating openings. A male terminal connector mates with the female terminal connector. The male terminal connector is disposed on the power supply side of the electric circuit and has an insulating male housing provided with male terminals. Insulating resin members cover tip ends and both side surfaces of each of the male terminals.

DETAILED DESCRIPTION OF THE INVENTION

Figure 1:
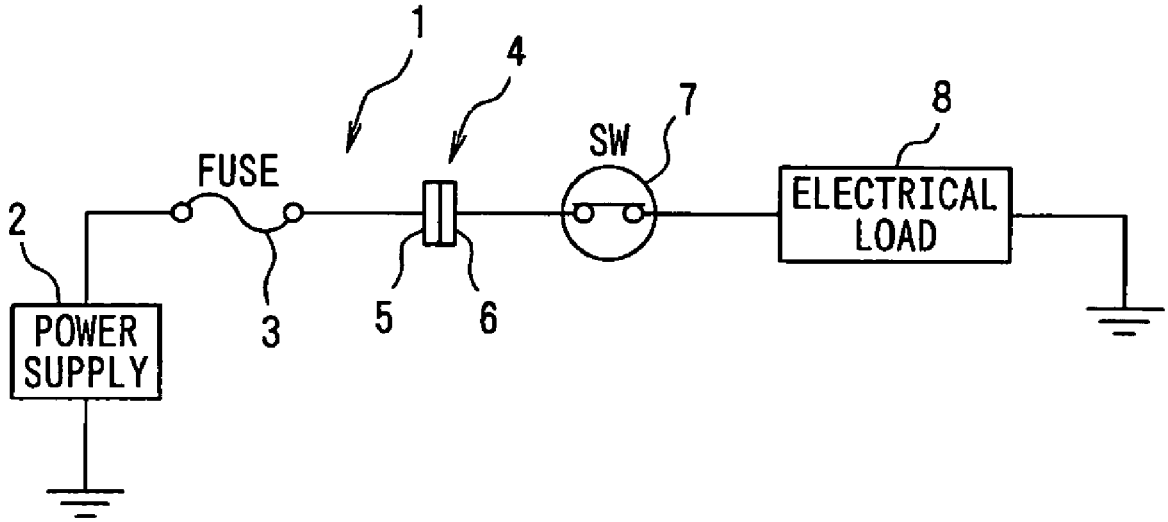
FIG. 1 is a schematic structural diagram of an electrical circuit of an automobile in which an automobile connector assembly according to the invention is used.

FIG. 1 shows an electrical circuit 1 for an automobile comprising a power supply 2 that supplies a specified power supply voltage (42 V), an electrical load 8 that is operated by the power supply 2, and an automobile connector assembly 4 that connects the power supply 2 and the electrical load 8. The automobile connector assembly 4 is constructed from a male terminal connector 5 that is disposed on a side of the power supply 2 and a female terminal connector 6 that is disposed on a side of the electrical load 8. The male terminal connector 5 and the female terminal connector 6 are formed to mate with each other. A fuse 3, which prevents the flow of an overcurrent, is connected between the power supply 2 and the automobile connector assembly 4. A switch 7, which drives the electrical load 8, is connected between the automobile connector assembly 4 and the electrical load 8.

Figure 2:
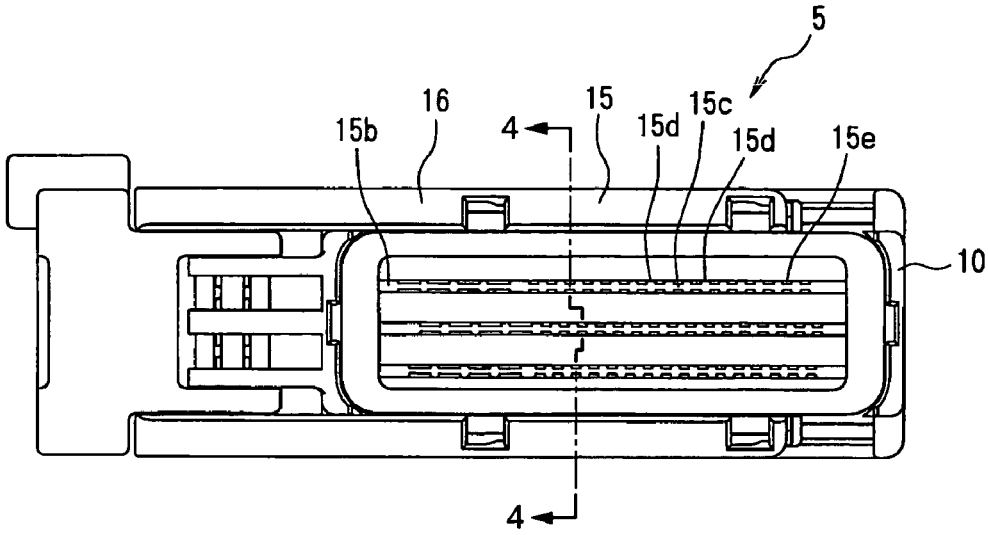
FIG. 2 is a front view of a male terminal connector.
Figure 3:
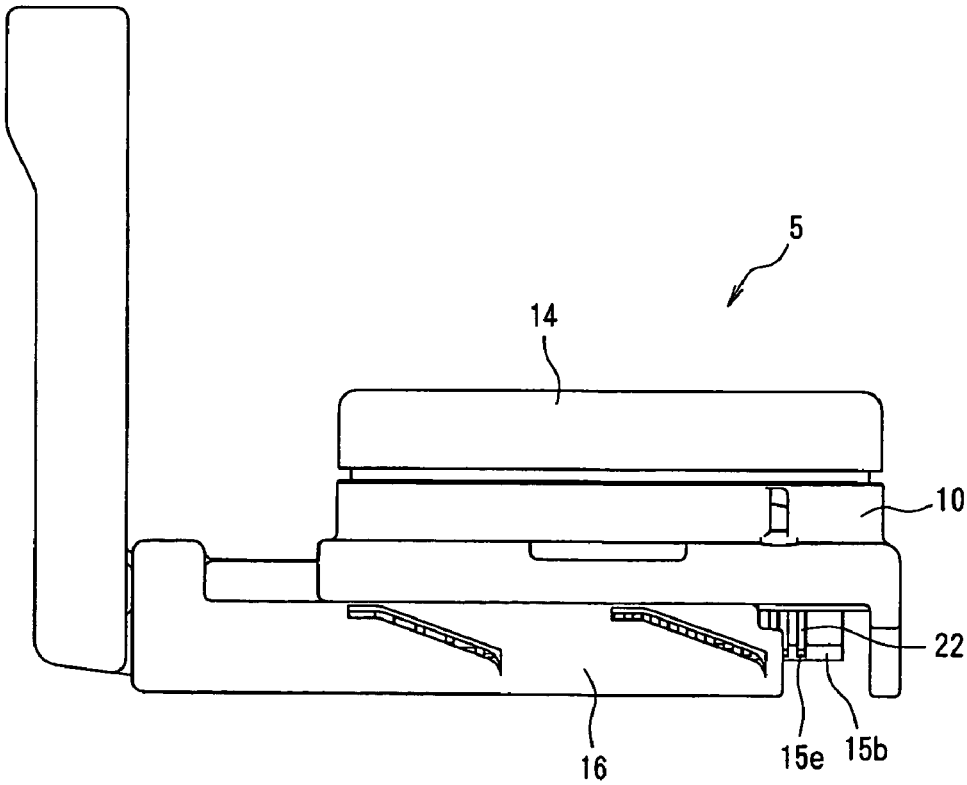
FIG. 3 is plan view of the male terminal connector.
Figure 4:
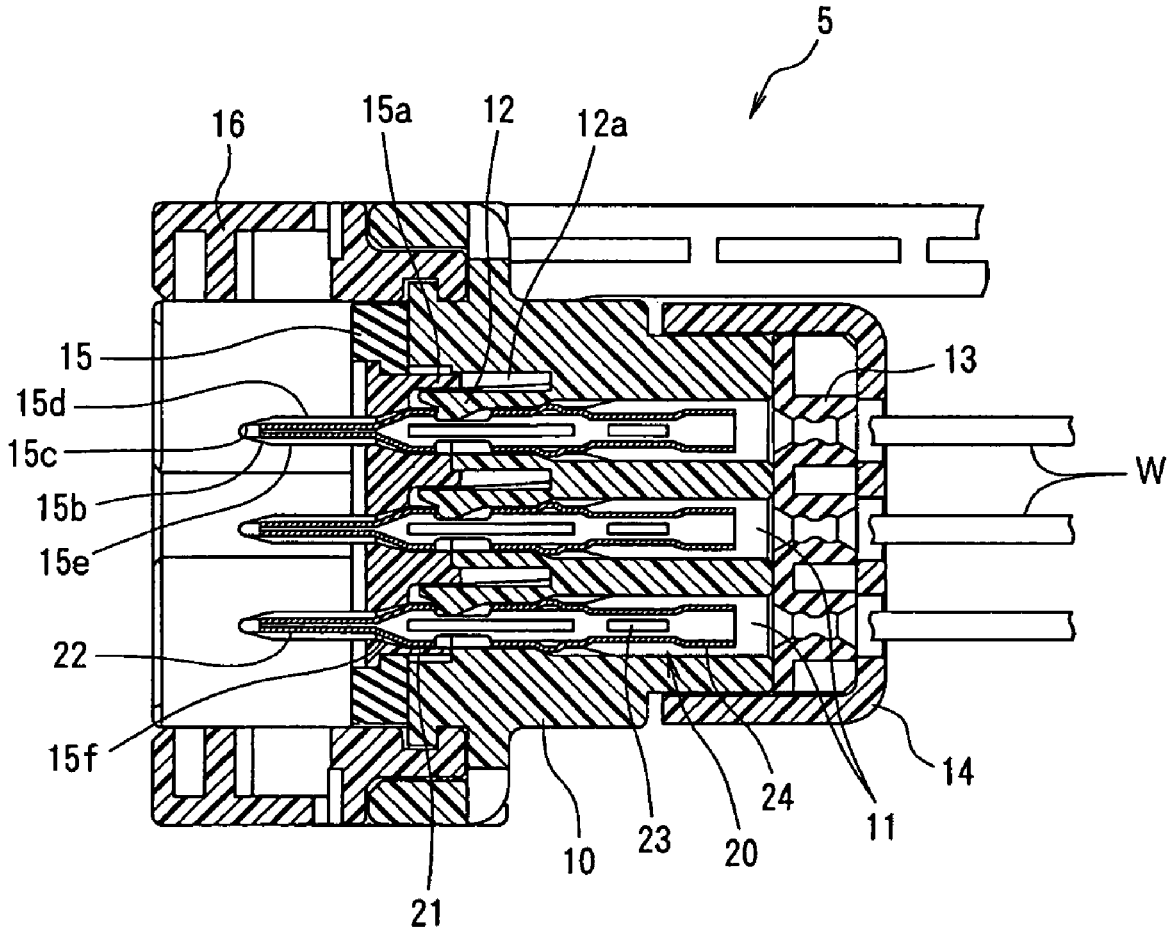
FIG. 4 is a sectional view taken along line 4—4 of FIG. 2.

As shown in FIG. 2, the male terminal connector 5 comprises a substantially rectangular insulating male housing 10. As shown in FIG. 4, a plurality of male terminal accommodating openings 11 is formed in rows in the male housing 10. A plurality of male terminals (male signal terminals 20 and male power supply terminals 30) is provided in the male housing 10. In the illustrated embodiment shown in FIG. 2, the male power supply terminals 30 (FIG. 6) are accommodated in the first four male terminal accommodating openings 11 from the left in each row, and the male signal terminals 20 (FIG. 5) are accommodated in the remaining male terminal accommodating openings 11. As shown in FIG. 4, housing lances 12, which effect primary locking of the respective male power supply terminals 20 and male signal terminals 30, are disposed in the male terminal accommodating openings 11 of the male housing 10. Spaces 12*a* are formed on upper sides of the housing lances 12 and are formed to allow for the displacement of the housing lances 12. A waterproofing sealing member 13 is disposed on a rear (right-hand side of FIG. 4) of the male housing 10. The sealing member 13 is attached to the male housing 10, for example, by a cap 14. As shown in FIG. 3, a hood 16 is attached to the front side of the male housing 10.

Figure 7:
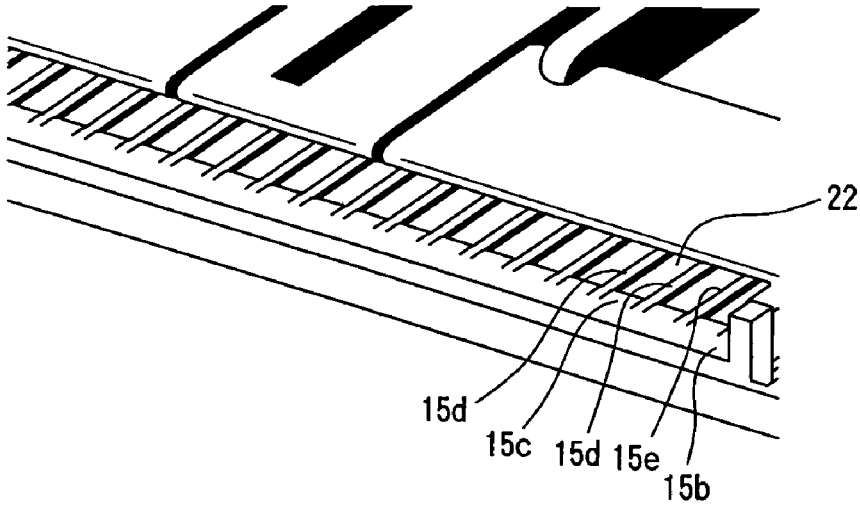
FIG. 7 is a partial schematic perspective view of the male terminal connector showing an area where the male signal terminals are disposed.
Figure 8:
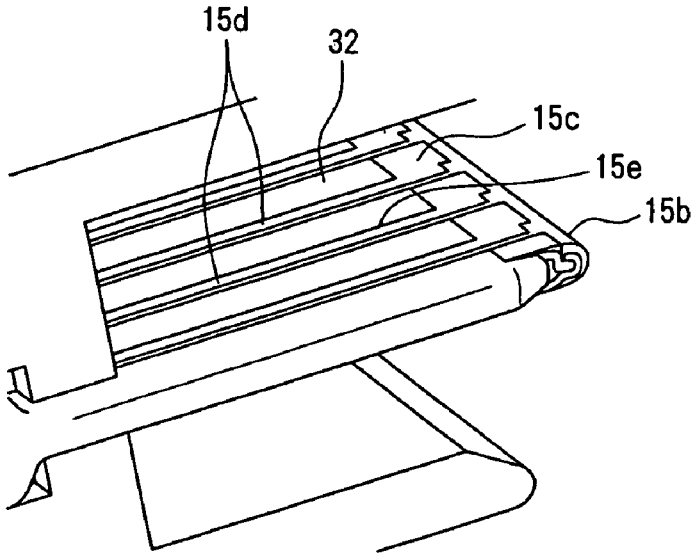
FIG. 8 is a partial schematic perspective view of the male terminal connector showing an area where the male power supply terminals are disposed.

As shown in FIG. 4, a front retainer 15 is disposed on a front of the male housing 10 and secondarily locks the male power supply terminals 20 and male signal terminals 30. The front retainer 15 is disposed on the front of the male housing 10 so that the front retainer 15 can move between a temporary locking position and a main locking position. The front retainer 15 is provided with a plurality of regulating members 15*a* that enter the spaces 12*a* located above the respective housing lances 12 to regulate the upward displacement of the housing lances 12 in the main locking position, as shown in FIG. 4. A plurality of contact member receiving through-holes 15*f* is formed in the front retainer 15. A plurality of plate-form platforms 15*b* extend forward from positions corresponding to the contact member receiving through-holes 15*f* in a vertical direction. Contact member exposing through-holes 15*e*, which extend in the vertical direction, are formed in the respective plate-form platforms 15*b*. Insulating resin members 15*c* are positioned forward of the contact member exposing through-holes 15*e*. Second insulating resin members 15*d* extend from both side surfaces of the insulating resin members 15*c*, as shown in FIGS. 7–8. Tip ends of the male contact members 22 of the respective male signal terminals 20 and the male contact members 32 of the respective male power supply terminals 30 are covered by the insulating resin members 15*c*, and both side surfaces of male contact members 22 of the respective male signal terminals 20 and the male contact members 32 of the respective male power supply terminals 30 are covered by the insulating resin members 15*d*.

Figure 5:
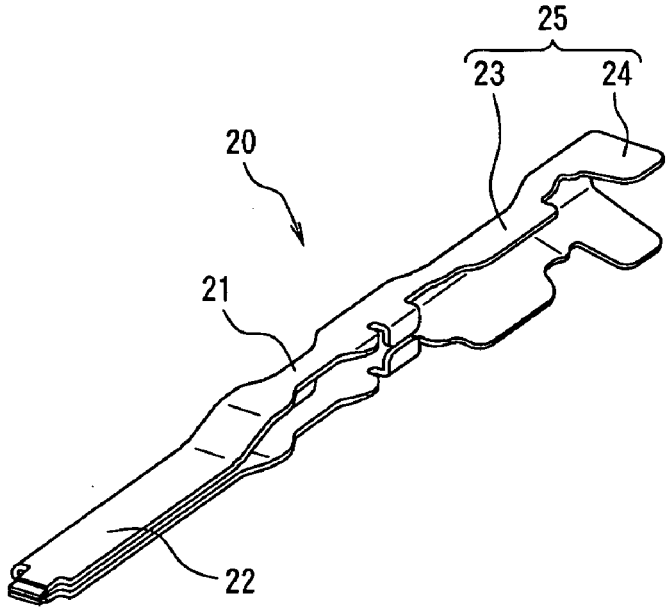
FIG. 5 is a perspective view of a male signal terminal.

As shown in FIGS. 4–5, each of the male signal terminals 20 comprises a locking member 21 for engaging with the housing lance 12, a plate-form male contact member 22 that extends forward from the locking member 21, and an electrical wire connecting member 25 that extends rearward from the locking member 21. The electrical wire connecting member 25 comprises a core wire barrel 23 that is connected by crimping to a core wire of an electrical wire W, and an insulation barrel 24 that is connected by crimping to a covering member of the electrical wire W. The electrical wires W connected to the electrical wire connecting members 25 are connected to respective lines on the side of the power supply 2. Each of the male signal terminals 20 may be formed, for example, by stamping and forming a metal plate.

Figure 6:
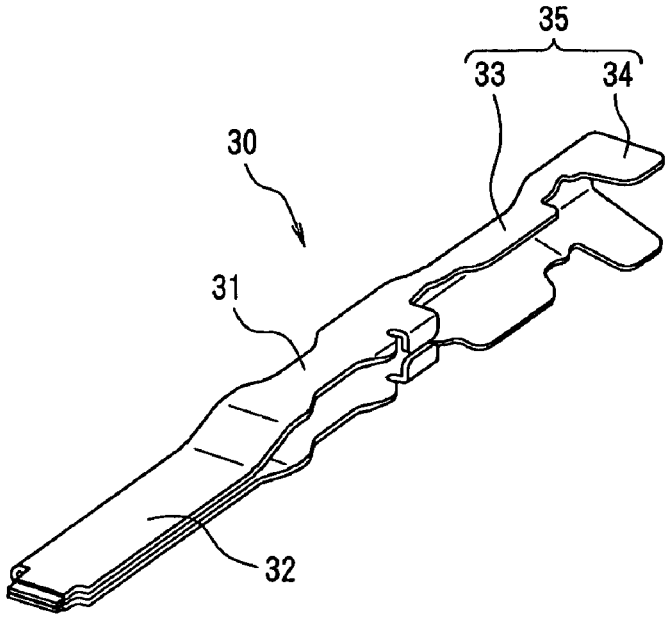
FIG. 6 is a perspective view of a male power supply terminal.

As shown in FIG. 6, each of the male power supply terminals 30 comprises a locking member 31 for engaging with the housing lance 12, a plate-form male contact member 32 that extends forward from the locking member 31, and an electrical wire connecting member 35 that extends rearward from the locking member 31. The electrical wire connecting member 35 comprises a core wire barrel 33 that is connected by crimping to the core wire of the electrical wire W, and an insulation barrel 34 that is connected by crimping to the covering member of the electrical wire W. The electrical wires W that are connected to the electrical wire connecting members 35 are connected to respective lines on the side of the power supply 2. The male power supply terminals 30 are formed with a larger width than the male signal terminals 20 since the current that flows through the male power supply terminals 30 is greater than the male signal terminals 20. Each of the male power supply terminals 30 may be formed, for example, by stamping and forming a metal plate.

Figure 9:
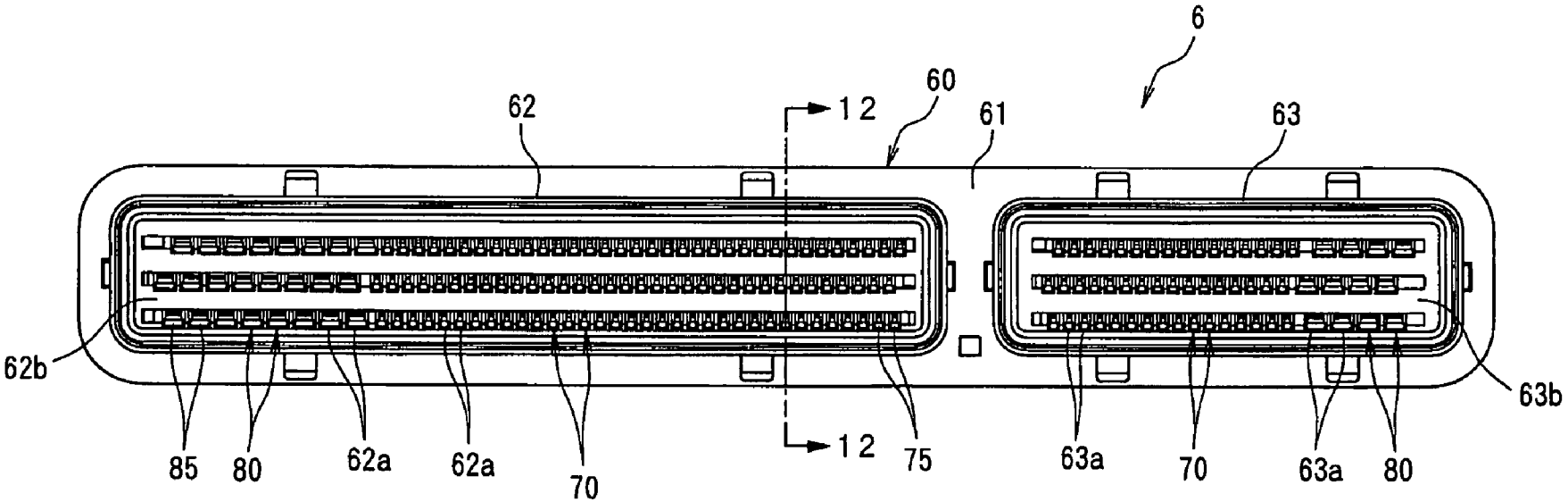
FIG. 9 is a front view of a female terminal connector.

As shown in FIG. 9, the female terminal connector 6 comprises an insulating female housing 60. The female housing 60 comprises a substantially rectangular housing base member 61. A first mating member 62 and a second mating member 63 protrude forward (leftward in FIG. 11) from the housing base member 61. The first mating member 62 and second mating member 63 are each formed with a substantially rectangular shape. A plurality of female terminal accommodating openings 62*a* formed in rows is provided in the first mating member 62. A plurality of female terminal accommodating openings 63*a* formed in rows is provided in the second mating member 63. A plurality of female terminals (female signal terminals 70 and female power supply terminals 80) is provided in the female housing 60. In the illustrated embodiment shown in FIG. 9, the first mating member 62 is shown having the female power supply terminals 80 (FIG. 14) accommodated inside the first eight female terminal accommodating openings 62*a* from the left in each row, and the female signal terminals 70 (FIG. 13) accommodated inside the remaining female terminal accommodating openings 62*a*. The second mating member 63 is shown as having the female power supply terminals 80 (FIG. 14) accommodated inside the first four female terminal accommodating openings 63*a* from the right in each row, and the female power supply terminals 70 (FIG. 13) accommodated inside the remaining female terminal accommodating openings 63*a*.

Figure 10:
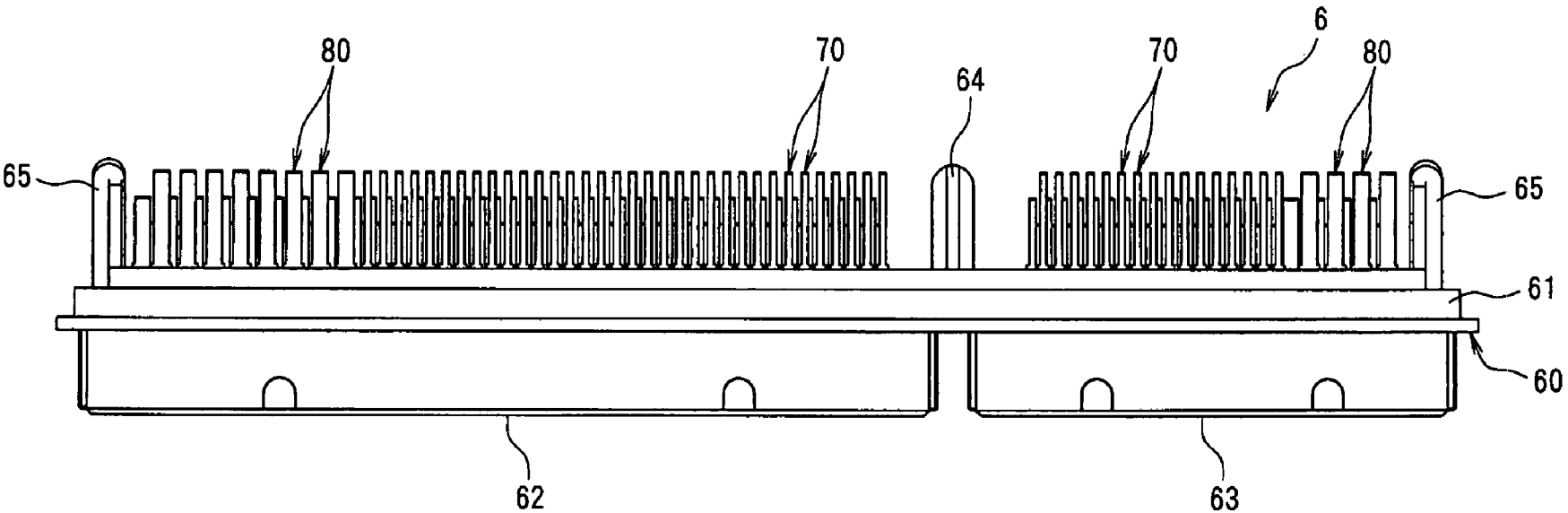
FIG. 10 is a plan view of the female terminal connector.
Figure 11:
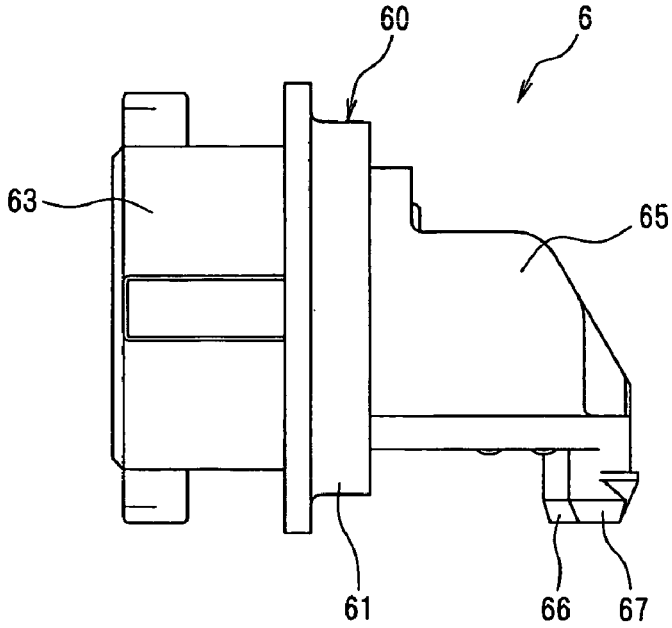
FIG. 11 is a right-side view of the female terminal connector.
Figure 12:
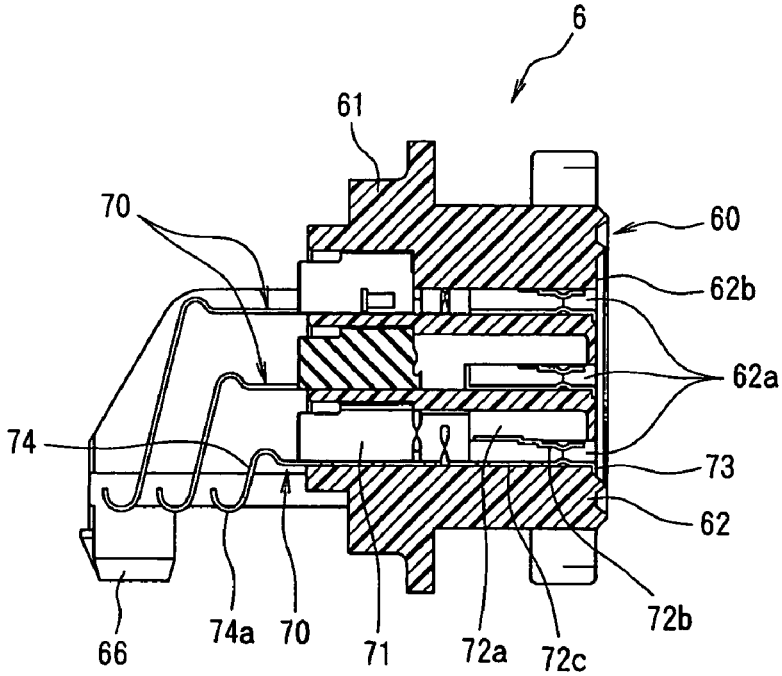
FIG. 12 is a sectional view taken along line 12—12 of FIG. 9.

As shown in FIG. 10, a partition wall 64 is positioned between the female signal terminals 70 extending from the first mating member 62 and the female signal terminals 70 extending from the second mating member 63 and is disposed on a rear surface of the housing base member 61. A pair of walls 65 are positioned on an outside of the female power supply terminals 80 extending from the first mating member 62 and the female power supply terminals 80 extending from the second mating member 63 and are disposed on the rear surface of the housing base member 61. As shown in FIGS. 11–12, a positioning projection 66 is provided on a lower end of the partition wall 64. A second positioning projection 67 is provided on lower ends of each of the walls 65. The positioning projection 66 and the second positioning projection 67 position the female terminal connector 6 during mounting on a circuit board (not shown).

Figure 13:
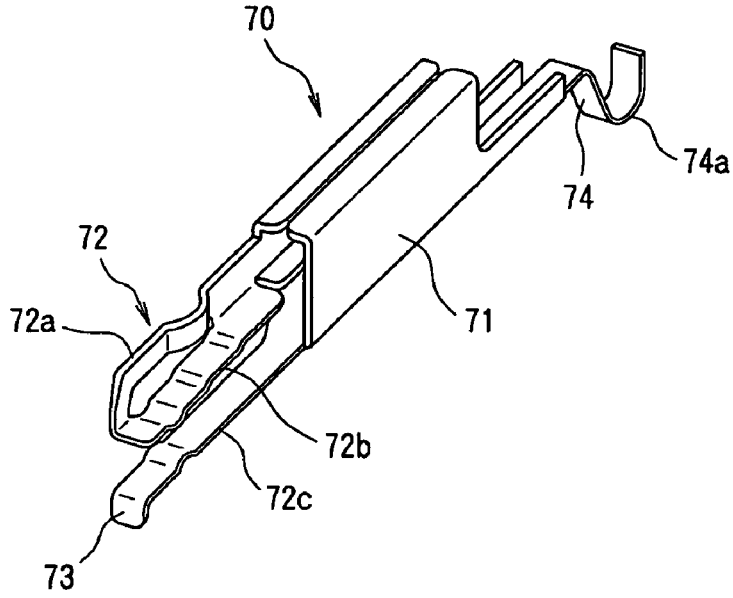
FIG. 13 is a perspective view of a female signal terminal.

As shown in FIGS. 12–13, each of the female signal terminals 70 comprises a fastening member 71 for fastening to the respective female terminal accommodating opening 62*a*, 63*a*, a female contact member 72 that extends forward from the fastening member 71, and a board connecting member 74 that extends rearward from the fastening member 71. The fastening member 71 is formed with a substantially box-form shape and has a pair of side walls that rise from either side of a bottom plate member of the female signal terminal 70.

The female contact member 72 comprises a side plate member 72*a*, an elastic plate member 72*b*, and a plate-form member 72*c*. The side plate member 72*a* extends forward from one of the side walls of the fastening member 71. The elastic plate member 72*b* is first bent inward from a front end of the side plate member 72*a* and then extends rearward. The plate-form member 72*c* extends forward from the bottom plate member of the female signal terminal 70 and is formed for positioning on a bottom surface of the female terminal accommodating opening 62*a*, 63*a*. The male contact member 22 of one of the male signal terminals 20 of the male terminal connector 5 enters the space between the elastic plate member 72*b* and the plate-form member 72*c* of the corresponding female contact member 72, so that the elastic plate member 72*b* elastically contacts an upper surface of the male contact member 22, and the plate-form member 72*c* contacts an undersurface of the male contact member 22.

The board connecting member 74 has a shape and dimension such that the board connecting member 74 may be, for example, surface-mounted on the circuit board (not shown) in a state in which a pre-load is applied to the circuit board (not shown). The board connecting member 74 may be connected to the circuit board (not shown), for example, by soldering. Accordingly, even if the circuit board (not shown) should become warped, this warped state can be absorbed so that the board connecting member 74 can be securely surface-mounted and connected to the circuit board (not shown). Moreover, the board connecting member 74 has a curved portion 74*a* that contacts the circuit board (not shown). Accordingly, the shape of the contact point of the board connecting member 74 with respect to the circuit board (not shown) does not vary so that there is no variation in the fillet shape in cases where the board connecting member 74 is connected to the circuit board (not shown) by soldering.

Figure 15:
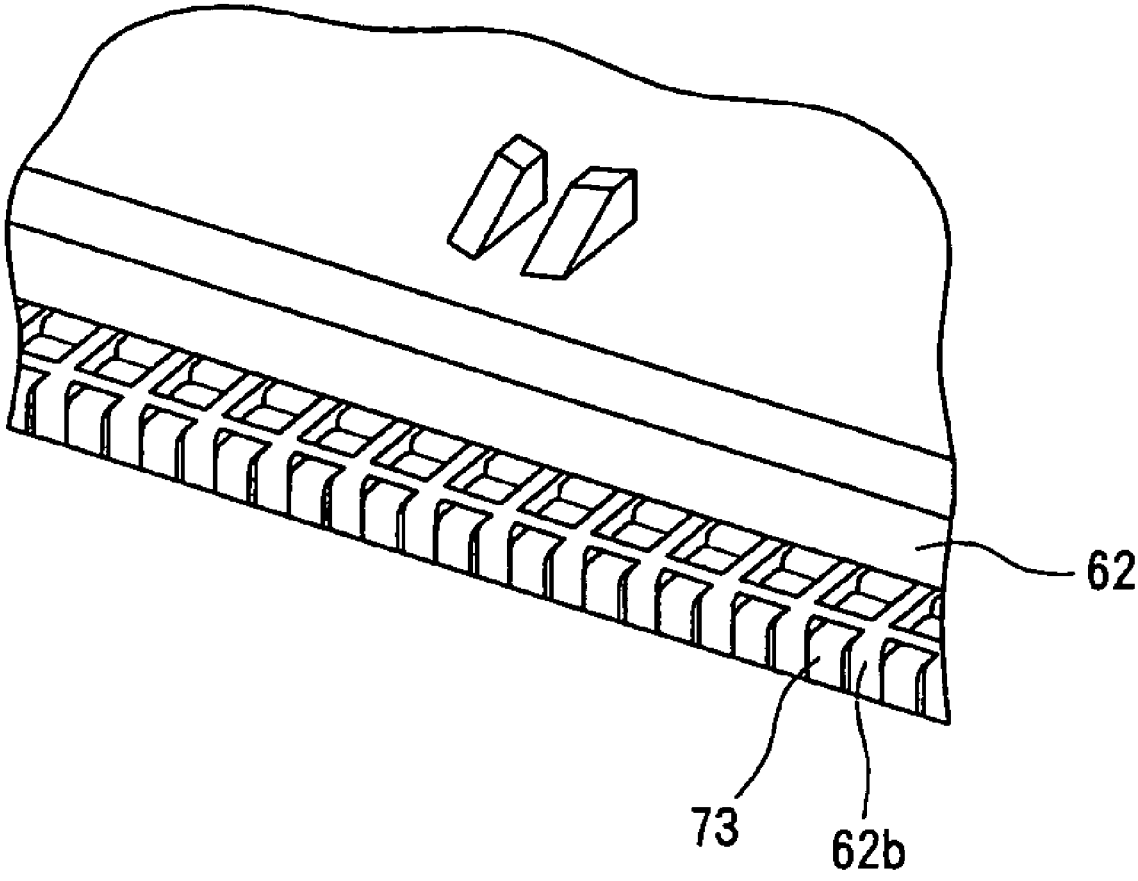
FIG. 15 is a partial schematic perspective view of the female terminal connector showing an area where the female signal terminals are disposed.
Figure 16A:
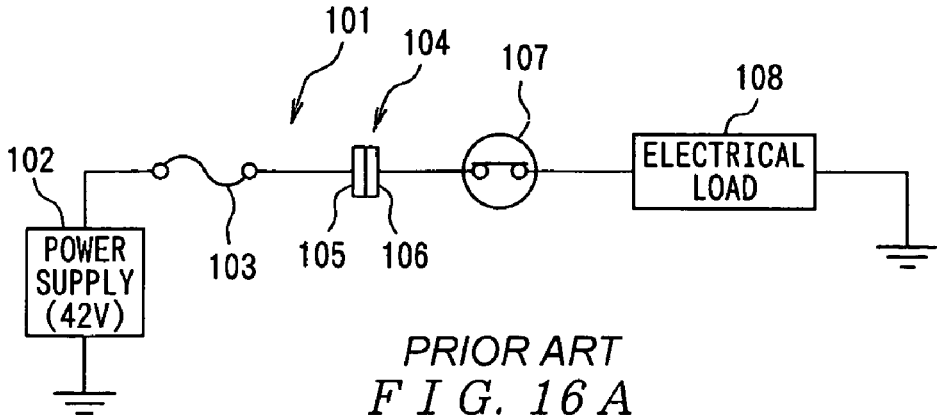
PRIOR ART FIG. 16A
FIG. 16A is a schematic structural diagram of electrical circuit of an automobile in which an automobile connector assembly according to the prior art is used.
Figure 16B:
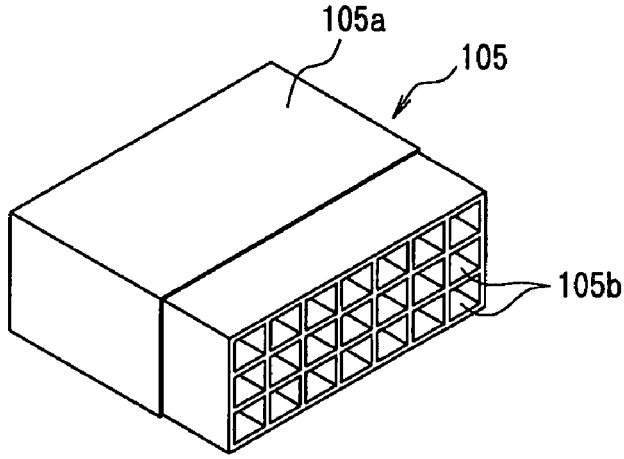
PRIOR ART FIG. 16B
FIG. 16B is a perspective view of a female terminal connector according to the prior art.
Figure 16C:
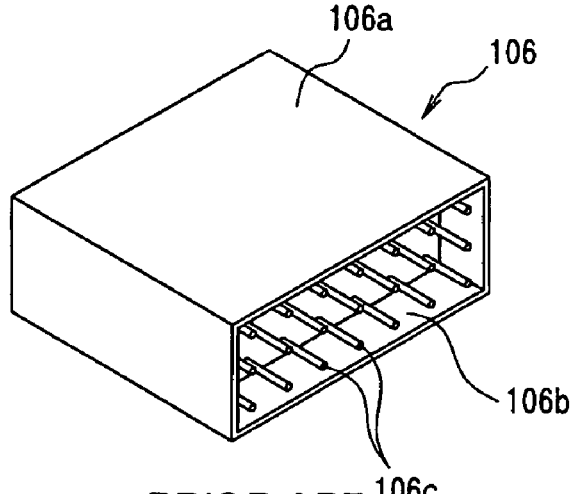
PRIOR ART FIG. 16C
FIG. 16C is a perspective view of a male terminal connector according to the prior art.

As shown in FIGS. 12–13 and 15, a contact member 73 is bent downward from a front end of the plate-form member 72*c*. The contact member 73 is configured for use with an electrical continuity checker (not shown) and is exposed on the front surface 62*b* of the first mating member 62 or the front surface 63*b* of the second mating member 63. Accordingly, the conditions of electrical continuity of the female signal terminals 70 can be checked by causing a probe (not shown) of an electrical continuity checker (not shown) to contact the contact member 73. Each of the female signal terminals 70 may be formed, for example, by stamping and forming a metal plate.

Figure 14:
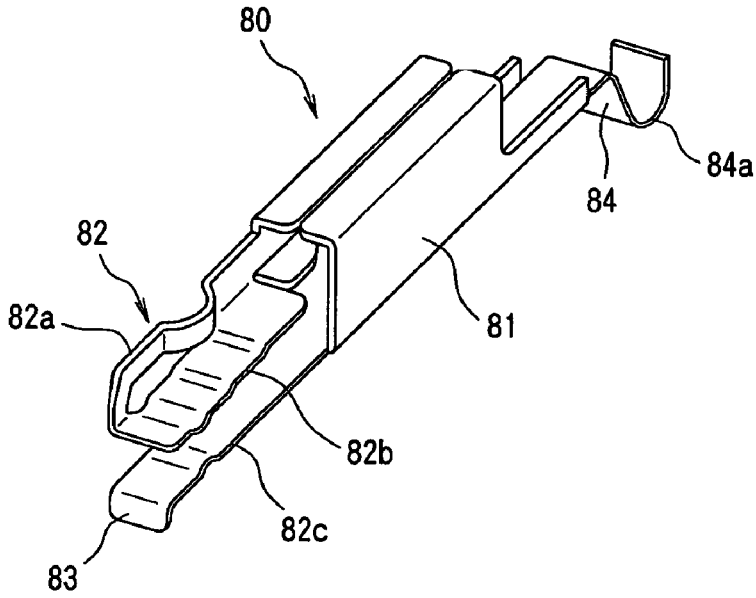
FIG. 14 is a perspective view of a female power supply terminal.

As shown in FIG. 14, each of the female power supply terminals 80 comprises a fastening member 81 that is fastened to one of the respective female terminal accommodating openings 62*a*, 63*a*, a female contact member 82 that extends forward from the fastening member 81, and a board connecting member 84 that extends rearward from the fastening member 81 and is connected, for example, by soldering to the circuit board (not shown). The fastening member 81 is formed with a substantially box-form shape and has a pair of side walls that rise from either side of a bottom plate member of the female power supply terminal 80. The female power supply terminals 80 are formed with a larger width than the female signal terminals 70, since the current that flows through the female power supply terminals 80 is greater than the female signal terminals 70.

The female contact member 82 comprises a side plate member 82*a* that extends forward from one of the side walls of the fastening member 81, an elastic plate member 82*b* which is first bent inward from the front end of the side plate member 82*a* and which then extends rearward, and a plate-form member 82*c* which extends forward from the bottom plate member of the female power supply terminal 80 for power supply use and which is positioned on a bottom surface of the female terminal accommodating opening 62*a*, 63*a*. The male contact member 32 of one of the male power supply terminals 30 of the male terminal connector 5 enters the space between the elastic plate member 82*b* and plate-form member 82*c* of the female contact member 82, so that the elastic plate member 82*b* elastically contacts an upper surface of the male contact member 32, and the plate-form member 82*c* contacts an undersurface of the male contact member 32.

The board connecting member 84 has a shape and dimension such that the board connecting member 84 may be, for example, surface-mounted on the circuit board (not shown) in a state in which a pre-load is applied to the circuit board (not shown). Accordingly, even if the circuit board (not shown) should become warped, this warped state is absorbed so that the board connecting member 84 can be securely surface-mounted and connected to the circuit board (not shown). Moreover, the board connecting member 84 has a curved portion 84*a* that contacts the circuit board (not shown). Accordingly, the shape of the contact point of the board connecting member 84 with respect to the circuit board (not shown) does not vary, so that there is no variation in the fillet shape in cases where the board connecting member 84 is connected to the circuit board (not shown) by soldering.

As shown in FIG. 14, each of the female power supply terminals 80 comprises a contact member 83 bent downward from the front end of the plate-form member 82*c*. The contact member 83 is configured for use with the electrical continuity checker (not shown) and is exposed on the front surface 62*b* of the first mating member 62 or the front surface 63*b* of the second mating member 63. Accordingly, the conditions of electrical continuity of the female power supply terminal 80 can be checked by causing the probe (not shown) of the electrical continuity checker (not shown) to contact the contact member 83. Each of the female power supply terminals 80 may be formed, for example, by stamping and forming a metal plate.

When the male terminal connector 5 and female terminal connector 6 are mated, the male contact members 22 of the male signal terminals 20 respectively contact the female contact members of the female signal terminals 70, and the male contact members 32 of the male power supply terminals 30 respectively contact the female contact members 82 of the female power supply terminals 80. As a result, the respective lines on the side of the power supply 2 and the respective lines on the side of the electrical load 8 are electrically connected.

Since the male terminal connector 5 is disposed on the side of the power supply 2, and the female terminal connector 6 is disposed on the side of the electrical load 8, the female terminal connector 6 is disposed on the opposite side from the side to which the power supply voltage is applied. Accordingly, in the female terminal connector 6, the walls between the mutually adjacent female terminal accommodating openings 62*a*, 62*a*, 63*a*, 63*a* in the female terminal connector 6 can be formed with a small thickness, thus allowing the size of the female terminal connector 6 to be reduced. Consequently, the male terminal connector 5 can also be reduced in size. Moreover, the tip ends and both side surfaces of the male signal terminals 20 and the tip ends and both side surfaces of the male power supply terminals 30 disposed in the male terminal connector 5 are covered by an insulating resin 15*c*, 15*d*, 15*d*, 15*c*, 15*d*, 15*d*. Short-circuiting and arc discharge between adjacent male signal terminals 20 and adjacent male power supply terminals 30, 30 disposed on the side of the power supply 2 can therefore be securely prevented even in cases where a power supply voltage of 42 V is used in a high-voltage automobile. Furthermore, the female signal terminals 70 and the female power supply terminals 80 that are disposed on the side of the electrical load 8 are accommodated inside the female terminal accommodating openings 62*a*, 63*a*. Accordingly, the problem of short-circuiting or arc discharge between adjacent female signal terminals 70 and female power supply terminals 80 is eliminated.

The foregoing illustrates some of the possibilities for practicing the invention. Many other embodiments are possible within the scope and spirit of the invention. For example, it will be appreciated by those skilled in the art that more or less than two of the mating members 62, 63 may be installed in the female connector 6. Additionally, the number of male signal terminals 20, male power supply terminals 30, female signal terminals 70, and/or female power supply terminals 80 disposed in the respective male and female connectors 5, 6 are not restricted to the numbers shown herein, but may be varied depending on the desired application. It is, therefore, intended that the foregoing description be regarded as illustrative rather than limiting, and that the scope of the invention is given by the appended claims together with their full range of equivalents.

What is claimed is:

1. An automobile connector assembly that connects a power supply side and an electrical load side of an electrical circuit in an automobile, the assembly comprising:

a female terminal connector disposed on the electrical load side of the electric circuit, the female terminal connector having a female housing provided with female terminals positioned within female terminal accommodating openings;

a male terminal connector that mates with the female terminal connector, the male terminal connector disposed on the power supply side of the electric circuit and having an insulating male housing provided with male terminals; and insulating resin members covering tip ends and both side surfaces of each of the male terminals.

2. The assembly of claim 1, wherein the insulating resin members are formed on a retainer disposed on the male housing.

3. The assembly of claim 1, wherein the male terminals include male contact members at the tip ends thereof that physically engage the female terminals, the male contact members being partially covered by the insulating resin members.

4. The assembly of claim 1, wherein the female terminals include board connecting members surface mounted on a circuit board, the female terminals being surface mounted to the circuit board in a state in which a pre-load is applied.

5. The assembly of claim 4, wherein the board connecting members include a curved portion, the curved portion being surface mounted to the circuit board.

6. The assembly of claim 1, wherein the female terminals include a contact member exposed from the female housing such that the contact member can be contacted by an electrical continuity checker.

7. The assembly of claim 1, wherein the female housing includes a first and second mating member, the female terminals disposed in the first mating member being separated from the female terminals disposed in the second mating member by a partition wall extending from the female housing.

8. The assembly of claim 1, wherein the male terminals include male signal terminals and male power supply terminals and the female terminals include female signal terminals and female power supply terminals.

9. The assembly of claim 2, wherein the retainer locks the male terminals in the male housing.

10. The assembly of claim 9, wherein the retainer is moveable between a temporary locking position and a main locking position.

11. The assembly of claim 2, wherein the retainer is disposed on a front of the male housing.

12. An automobile connector assembly that connects a power supply side and an electrical load side of an electrical circuit in an automobile, the assembly comprising:

a female terminal connector disposed on the electrical load side of the electric circuit, the female terminal connector having a female housing provided with female terminals positioned within female terminal accommodating openings;

a male terminal connector that mates with the female terminal connector, the male terminal connector disposed on the power supply side of the electric circuit and having an insulating male housing provided with male terminals, the male terminals having male contact members, the male contact members having tip ends, opposing side surfaces and opposing upper and under surfaces; and insulating resin members covering the tip ends and both side surfaces of each of the male contact members such that the opposing upper and under surfaces thereof are exposed for making electrical contact with the female terminals.

13. The assembly of claim 12, wherein the insulating resin members are formed on a front retainer disposed on the male housing.

14. The assembly of claim 13, wherein the retainer locks the male terminals in the male housing.

15. The assembly of claim 14, wherein the retainer is moveable between a temporary locking position and a main locking position.

16. The assembly of claim 13, wherein the retainer is disposed on a front of the male housing.

17. The assembly of claim 12, wherein the female terminals include board connecting members surface mounted on a circuit board, the female terminals being surface mounted to the circuit board in a state in which a pre-load is applied.

18. The assembly of claim 12, wherein the female terminals include a contact member exposed from the female housing such that the contact member can be contacted by an electrical continuity checker.

19. The assembly of claim 12, wherein the female housing includes a first and second mating member, the female terminals disposed in the first mating member being separated from the female terminals disposed in the second mating member by a partition wall extending from the female housing.

20. The assembly of claim 12, wherein the male terminals include male signal terminals and male power supply terminals and the female terminals include female signal terminals and female power supply terminals.

* * * * *